US006530706B2

(12) United States Patent
Sugimoto et al.

(10) Patent No.: US 6,530,706 B2
(45) Date of Patent: Mar. 11, 2003

(54) PAPER FEED UNIT

(75) Inventors: Hiroyuki Sugimoto, Ibaraki-ken (JP); Akitoshi Yoshida, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/842,176

(22) Filed: Apr. 26, 2001

(65) Prior Publication Data

US 2001/0043831 A1 Nov. 22, 2001

(30) Foreign Application Priority Data

May 17, 2000 (JP) ..... 2000-145582

(51) Int. Cl.[7] ..... B65H 5/00

(52) U.S. Cl. ..... 400/625; 400/624; 271/10.09; 271/242

(58) Field of Search ..... 400/625, 626, 400/628, 629, 624; 271/10.01, 19, 21, 229, 10.09, 10.11, 226, 242

(56) References Cited

U.S. PATENT DOCUMENTS 4,023,254 A * 5/1977 Aiple et al. ..... 227/25
4,664,546 A * 5/1987 Runzi ..... 271/9.01
4,674,736 A * 6/1987 Tsubo ..... 271/122
4,735,109 A * 4/1988 Richards et al. ..... 74/331
4,945,678 A * 8/1990 Berner et al. ..... 192/150
5,085,420 A * 2/1992 Sata ..... 271/114
5,415,387 A * 5/1995 Suzuki ..... 271/10.01
5,683,047 A * 11/1997 Ohtake ..... 242/241
5,931,090 A * 8/1999 Ohkawa ..... 101/118
6,298,778 B1 * 10/2001 Onodera et al. ..... 101/116
6,382,542 B1 * 5/2002 Sato ..... 242/232

* cited by examiner

*Primary Examiner*—Andrew H. Hirshfeld
*Assistant Examiner*—Dave A. Ghatt
(74) *Attorney, Agent, or Firm*—Gary M. Nath; Harold L. Novick; Marvin C. Berkowitz

(57) ABSTRACT

A paper feed unit has a paper feed tray stacking sheets thereon, a primary paper feed roller and a secondary paper feed member, wherein an uppermost sheet among the sheets stacked on the paper feed tray is transferred toward the secondary paper feed member from the primary paper feed roller, a tip end of the sheet then contacts with the secondary paper feed member, and primary paper feed is then completed while the sheet is being bent. A counter rotation stop mechanism, which allows the primary paper feed roller to rotate in a paper feed direction but prevents the primary paper feed roller from rotating in a counter direction to the paper feed direction, and a rotation stop release mechanism, which releases a state in which the primary paper feed roller is prevented from rotating in the counter direction by the counter rotation stop mechanism, are also provided.

11 Claims, 7 Drawing Sheets

PAPER FEED UNIT

BACKGROUND OF THE INVENTION

The present invention relates to a paper feed unit, and more particularly, to a paper feed unit for further feeding a sheet from the position at which the tip end of the sheet contacts with a secondary paper feed member by a primary paper feed roller to complete primary paper feed in a state in which the sheet is being bent.

FIG. 7 is schematic structural diagram of a conventional paper feed unit A1.

In FIG. 7, many print sheets (or sheets) 2 are stacked on the paper feed tray 1 of the paper feed unit A1. A scraper roller 3 and a pickup roller 4, which are primary paper feed rollers, are located above the stacked print sheets 2. The scraper roller 3 press-contacts with the uppermost print sheet 2 and the pickup roller 4 press-contacts with a stripper tray 5.

The rotary shaft 6 of the pickup roller 4 and the rotary shaft 7 of the scraper roller 3 are coupled to each other by a driving belt V. The pickup roller 4 and the scraper roller 3 are rotated in paper feed rotation direction synchronously with each other by the rotation of the rotary shaft 6 of the pickup roller 4.

A pair of secondary paper feed rollers 8 and 9 are arranged to press-contact with each other on the transfer downstream side of the pickup roller 4. The paired secondary paper feed rollers 8 and 9 are driven to rotate in opposite rotation directions so as to transfer the print sheet 2 put between the rollers 8 and 9.

Also, a paper feed sensor 10 is provided between the pickup roller 4 and the paired secondary paper feed rollers 8 and 9. The paper feed sensor 10 detects the tip end of the print sheet 2 transferred from a primary paper feed side.

Description will be given to the paper feed operation of the paper feed unit constituted as stated above.

When the scraper roller 3 and the pickup roller 4 rotate synchronously with each other, at least the uppermost print sheet 2 press-contacted with the scraper roller 3 is transferred and then the transferred print sheet 2 is transferred to the position between the pickup roller 4 and the stripper tray 5.

Since the print sheet 2 which has been transferred to the position between the pickup roller 4 and the stripper tray 5 is press-contacted with the pickup roller 4, the sheet 2 is transferred further in response to the rotation of the pickup roller 4.

If it is assumed that a plurality of print sheets 2 are transferred to the position between the pickup roller 4 and the stripper tray 5, the uppermost print sheet 2 is applied with a transfer force by the rotation of the pickup roller 4 and the lowermost print sheet 2 is applied with a transfer resistance by the stripper tray 5, whereby only the uppermost print sheet 2 is transferred to the paired secondary paper feed rollers 8 and 9 side.

When the paper feed sensor 10 detects the tip end of the print sheet 2 transferred, the rotation of the scraper roller 3 and that of the pickup roller 4 are stopped at the point at which the print sheet 2 has been transferred by a predetermined distance with reference to this detection point. To be specific, the print sheet 2 is contacted with the paired secondary paper feed rollers 8 and 9 while the tip end thereof is put between the paired secondary paper feed rollers 8 and 9, and transferred further from this contact position. Then, primary paper feed is completed while the print sheet 2 is being bent as shown in FIG. 7.

If the primary paper feed is completed while the print sheet 2 is being bent as stated above and the paired secondary paper feed rollers 8 and 9 are driven to rotate, then the print sheet 2 is put between the paired secondary paper feed rollers 8 and 9 smoothly and surely by the returning force of the bent print sheet 2 for returning to a linear state while eliminating the inclination of the sheet caused by the oblique feed of the sheet during the transfer process. It is, therefore, possible to perform secondary paper feed at accurate, surely timing.

SUMMARY OF THE INVENTION

However, due to the further studies done by the inventors of the present invention, if the primary paper feed is completed in a state in which the print sheet 2 is being bent as shown in FIG. 7, the pickup roller 4 may be possibly rotated in counter direction by the returning force of the bent paper sheet 2 for returning to a linear state and the rear end of the paper sheet 2 moved in a counter transfer direction may possibly press the paper sheet 2 at the uppermost position of the paper feed tray 1. If such a phenomenon occurs, the position of the uppermost print sheet 2 on the paper feed tray 1 is disordered by the pressurization and the stability of the next primary paper feed is thereby hampered. If the print sheet 2 is a flexible, hard sheet (e.g., a postcard or a cardboard), in particular, the returning force of the bent print sheet 2 for returning to a linear state is strong and the probability that the position of the uppermost print sheet 2 on the paper feed tray 1 is disordered becomes higher.

To cope with the above-stated situation, the inventors of the present invention gave a consideration to a paper feed unit A2 shown in FIGS. 8 and 9.

As shown in FIGS. 8 and 9, the paper feed unit A2 is constituted such that a one-way clutch 11 is attached to the rotary shaft 6 of a pickup roller 4 compared with the paper feed unit A1 shown in FIG. 7.

The one-way clutch 11 is supported by a side plate 12 which is provided on a paper feed unit main body side to prevent the rotation of the clutch 11. The one-way clutch 11 allows the rotation of the rotary shaft 6 of the pickup roller 4 when the rotary shaft 6 rotates in a paper feed rotation direction a. The one-way clutch 11 is locked to the rotary shaft 6 when the rotary shaft 6 thereof rotates in a paper feed counterrotating direction b and applied with a counterrotating force on the side plate 12, thereby preventing the rotation of the rotary shaft 6.

In FIG. 9, a reference numeral 13 denotes a scraper support member supporting the scraper roller 3. The scraper support member 13 is rotatably supported by the rotary shaft 6 and constituted so as not to rotate when the rotary shaft 6 rotates.

That is to say, in the paper feed unit A2 stated above, if primary paper feed is completed in a state in which the print sheet 2 is being bent, a pressing force in the counterrotating direction acts on the pickup roller by the returning force of the bent print sheet 2 for returning to a linear state. However, since the counter rotation of this pickup roller 4 is stopped by the one-way clutch 11, it is possible to suppress the rear end of the primarily fed print sheet 2 from pressing the uppermost print sheet on the paper feed tray 1.

In case of the above-stated paper feed unit A2, however, the primarily fed print sheet 2 cannot be transferred in counter direction. Due to this, if the jamming of the primarily fed print sheet 2 occurs, the print sheet 2 which has caused jamming cannot be pulled out from a paper feed tray 1 side. In other words, with the constitution of the paper feed unit A2, it is difficult to eliminate the print sheet 2 which has causes jamming.

The present invention has been achieved with the above-stated studies. It is, therefore, an object of the present invention to provide a paper feed unit capable of preventing the positions of sheets on a paper feed tray by a primarily fed sheet and also easily removing the sheet which has caused jamming.

To obtain the above-stated object, a paper feed unit according to the present invention is provided with: a paper feed tray stacking sheets thereon; a primary paper feed roller; a secondary paper feed member provided downstream to the primary paper feed roller in a transferring direction of the sheets, wherein an uppermost sheet among the sheets stacked on the paper feed tray is transferred toward the secondary paper feed member by rotation of the primary paper feed roller, the sheet is further transferred while a tip end of the sheet contacts with the secondary paper feed member, and primary paper feed is then completed while the sheet is being bent; a counter rotation stop mechanism allowing the primary paper feed roller to rotate in a paper feed direction but preventing the primary paper feed roller from rotating in a counter direction to the paper feed direction; and a rotation stop release mechanism releasing a state in which the primary paper feed roller is prevented from rotating in the counter direction by the counter rotation stop mechanism.

Other and further features, advantages, and benefits of the present invention will become more apparent from the following description taken in conjunction with the following drawings.

DETAILED DESCRIPTION OF THE PREFERRED EMBODIMENT

An preferred embodiment of a paper feed unit according to the present invention will be described hereinafter in detail with reference to FIGS. 1 to 6B. In this embodiment, description will be given while taking a case of applying a paper feed unit A to the paper feed section SP of a printing machine S as an example. The printing machine S to which the paper feed unit A is applied is suitably exemplified by a stencil printing machine or the like.

Figure 1:
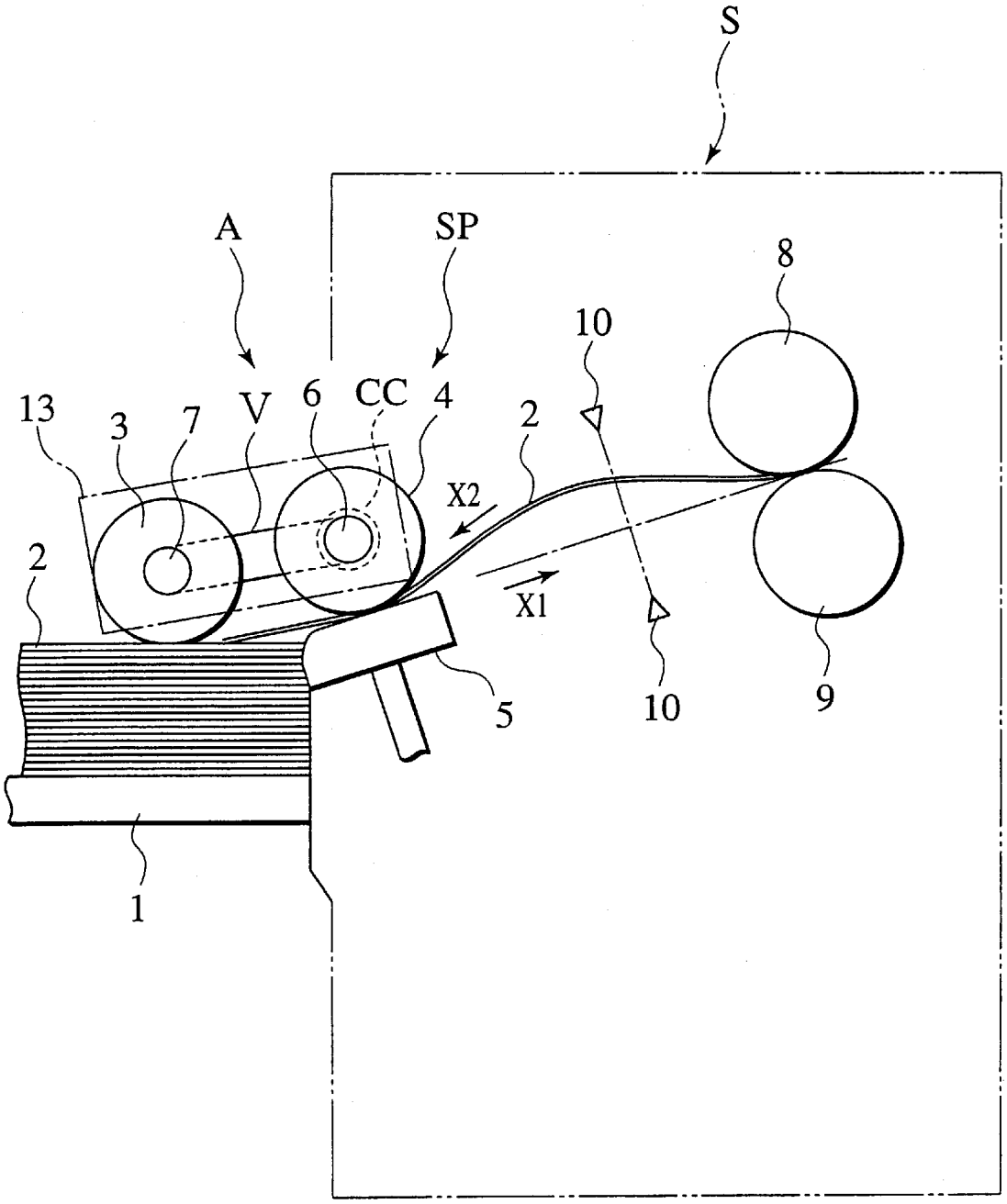
FIG. 1 is a schematic structural diagram of a paper feed unit according to an embodiment of the present invention.
Figure 2:
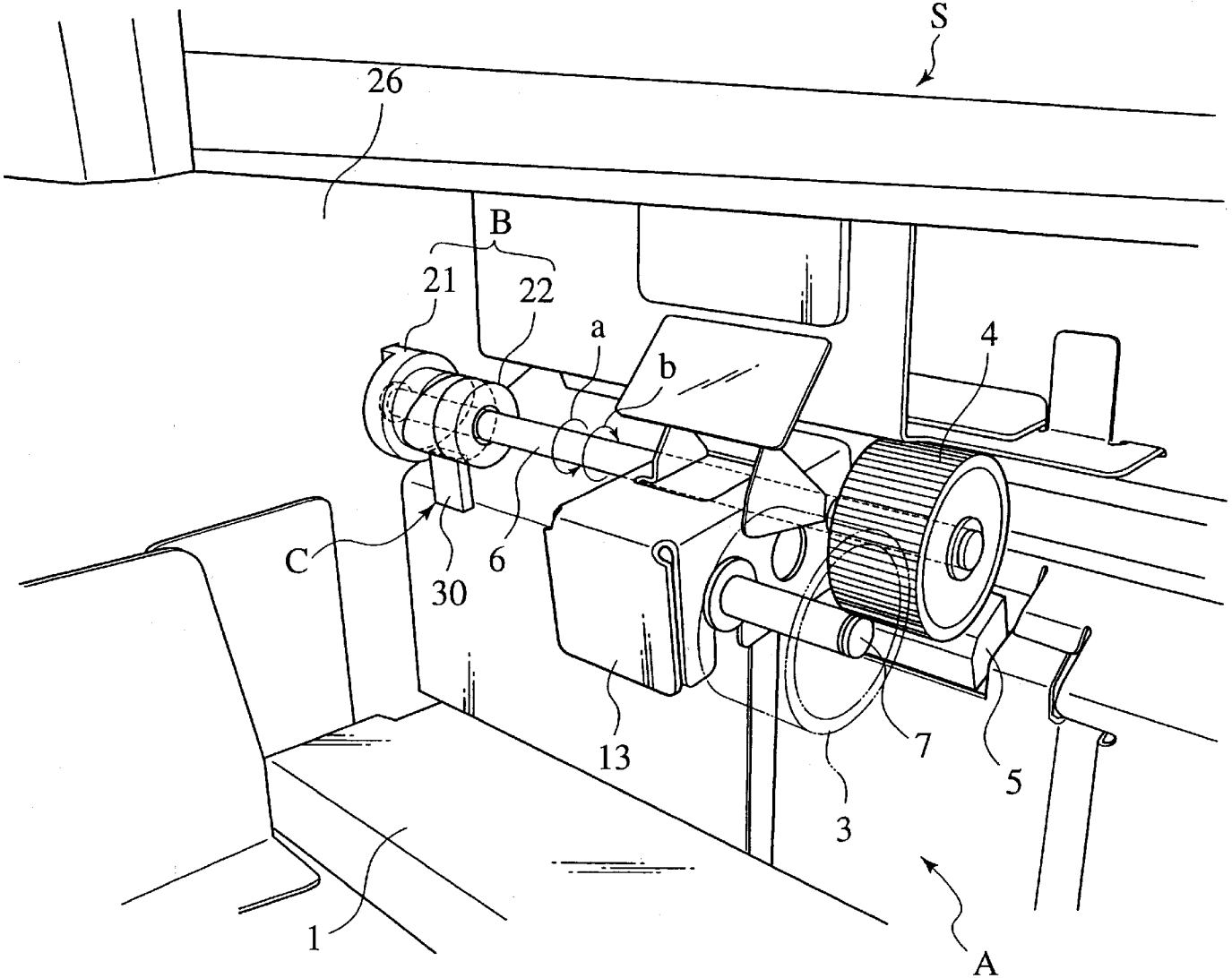
FIG. 2 is a perspective view of the paper feed unit according to the embodiment, which is seen from a paper feed tray side.
Figure 3:
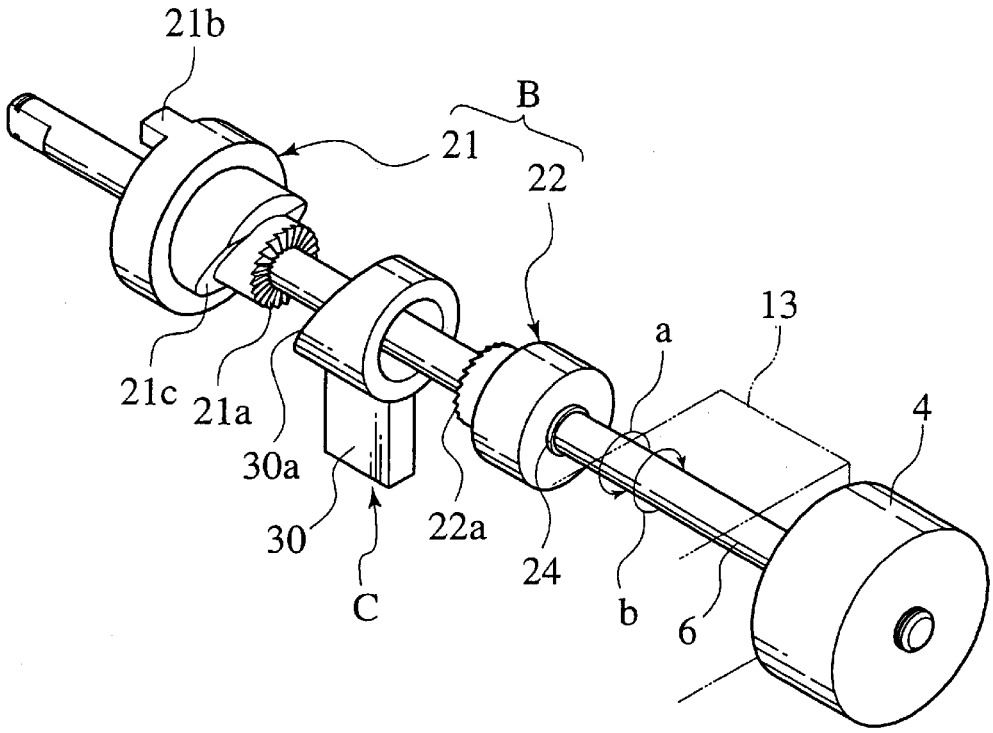
FIG. 3 is a perspective view showing members attached to the rotary shaft of the pickup roller of the paper feed unit according to the embodiment.
Figure 4:
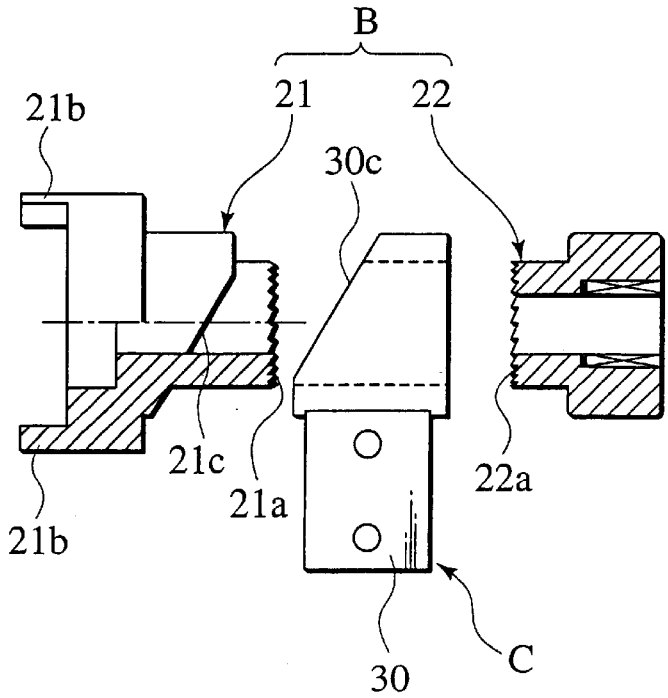
FIG. 4 is a partially cross-sectional front view showing the one-way clutch member, the stopper member and the operation lever for controlling the engagement and disengagement of the one-way clutch member and the stopper member of the paper feed unit according to the embodiment.

In FIG. 1, many print sheets (or sheets) 2 are stacked on the per feed tray 1 of the paper feed unit A. A scraper roller 3 and pickup roller 4, which are primary paper feed rollers, are located above the print sheets 2 thus stacked. The scraper roller press-contacts with the uppermost print sheet 2 and the pickup roller 4 press-contacts with a stripper tray 5. If necessary and suitable, it is needless to say that a single roller can be used as primary paper feed roller.

The rotary shaft 6 of the pickup roller 4 and the rotary shaft 7 of the scraper roller 3 are coupled to each other by a driving belt V. The pickup roller 4 and the scraper roller 3 are rotated in paper feed rotation direction synchronously with each other by the rotation of the rotary shaft 6 of the pickup roller 4.

A pair of secondary paper feed rollers 8 and 9 are arranged to press-contact with each other on the transfer downstream side of the pickup roller 4. The paired secondary paper feed rollers 8 and 9 are driven to rotate in opposite directions so as to transfer the print sheet 2 put between the rollers 8 and 9.

Also, a paper feed sensor 10 is provided between the pickup roller 4 and the paired secondary paper feed rollers 8 and 9. The paper feed sensor 10 detects the tip end of the print sheet 2 transferred from a primary paper feed side.

Referring further to FIGS. 2 to 6B, a counter rotation stop mechanism B comprises a stopper member 21 and a one-way clutch member 22 having engagement gear teeth 21*a* and 22*a* on their respective opposite surfaces.

Both the stopper member 21 and the one-way clutch member 22 are inserted into the rotary shaft 6. The stopper member 21 and the one-way clutch member 22 are constituted to be slidable in the axial direction of the rotary shaft 6 while the sliding ranges of the members 21 and 22 are restricted by left and right E rings 23 and 24 and to be movable between an engagement position at which their respective engagement gear teeth 21*a* and 22*a* are engaged with each other and a disengagement position at which the engagement gear teeth 21*a* and 22*a* are away and disengaged from each other.

A coiled slide spring 25 which winding shaft is the rotary shaft 6, is interposed between the E ring 23 and the stopper member 21. The stopper member 21 is urged against the one-way clutch member 22, i.e., urged toward the engagement position by the spring force of the slide spring 25.

The stopper member 21 is arranged to allow the rotation of the rotary shaft 6 and engagement protrusions 21*b* on the outer surface of the stopper member 21 are inserted into the engagement hole 26*a* of a side plate 26 on a paper feed unit main body side, whereby the stopper member 21 is unable to rotate toward the side plate 26.

An inclined face 21*c* is provided on the one-way clutch 22-side circumferential side surface of the stopper member 21.

The one-way clutch member 22 is constituted to allow the rotation of the rotary shaft 6 when the rotary shaft 6 rotates in a paper feed rotation direction a and to be locked to the rotary shaft 6 when the rotary shaft 6 rotates in a paper feed counterrotating direction b.

A rotation stop release mechanism C is provided at the rotary shaft 6. The mechanism C comprises the stopper member 21 and an operation lever 30 interposed between the stopper member 21 and the one-way clutch member 22.

The operation lever 30 is provided rotatably around the rotary shaft 6, which functions as the rotary shaft of the lever 30, toward the stopper member 21 and the one-way clutch member 22. An inclined face 30*a* corresponding to the inclined face 21*c* of the stopper member 21 is provided on the stopper member 21-side of the operation member 30.

Figure 5A:
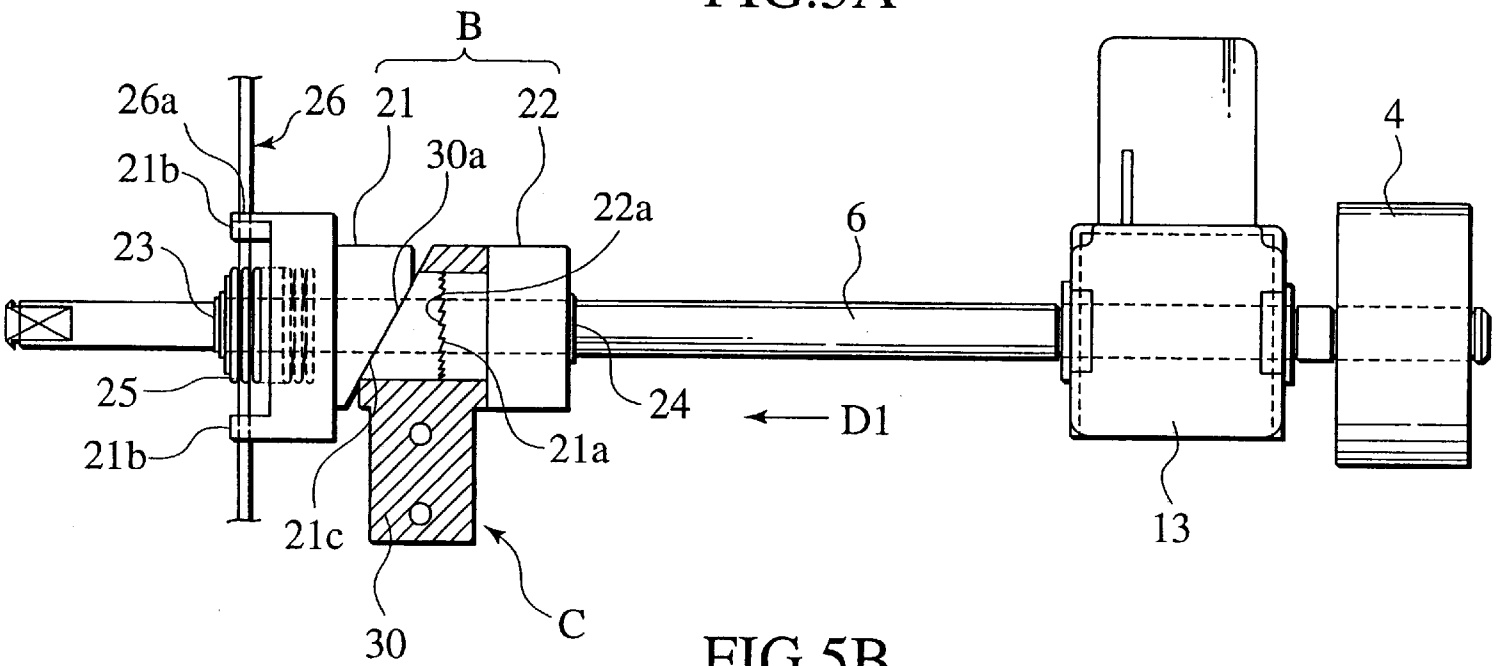
FIG. 5A is a partially cross-sectional front view showing the one-way clutch member, the stopper member and the operation member in a counter rotation stop state according to the embodiment.

As shown in FIGS. 5A and SB, at the rotation position of the operation member 30 at which position the inclined face 21*c* of the stopper member 21 and the inclined face 30*a* of the operation member 30 entirely contact with each other, the engagement gear teeth 21*a* and 22*a* of the stopper member 21 and the one-way clutch member 22, respectively, are press-contacted with each other by the spring force of the slide spring 25. The stopper member 21 and the one-way clutch member 21 are thereby integrated with each other.

Accordingly, the stopper member 21 and the one-way clutch member 22 realize, as a whole, a rotation stop state in which the rotation of the rotary shaft 6 in the paper feed counterrotating direction b is prevented.

Figure 6A:
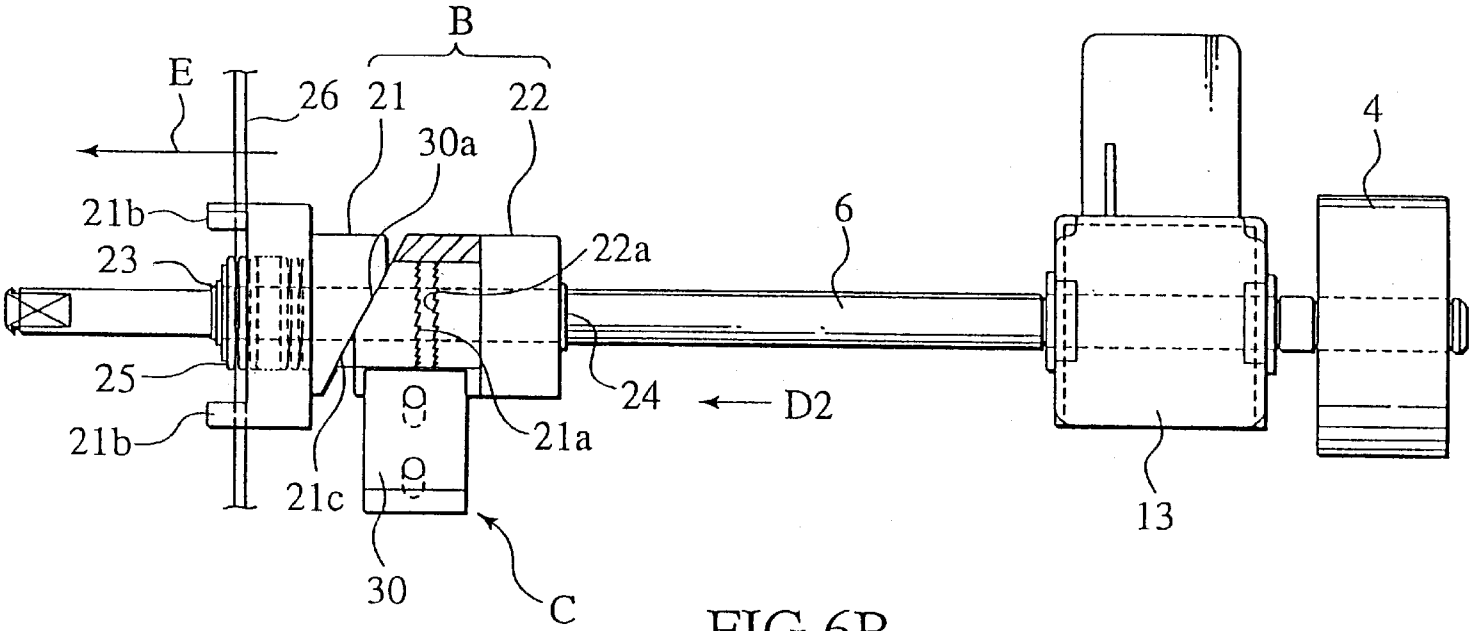
FIG. 6A is a partially cross-sectional front view showing the one-way clutch member, the stopper member and the operation lever in a counter rotation stop release state according to the embodiment.
Figure 6B:
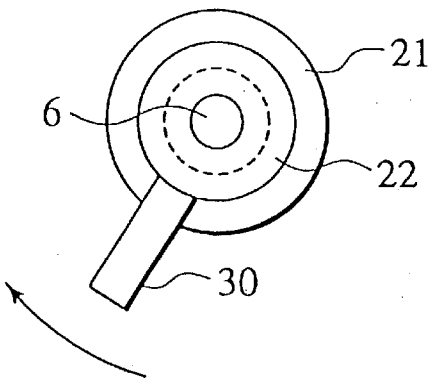
FIG. 6B is a view seen from D2 of FIG. 6A.
Figure 7:
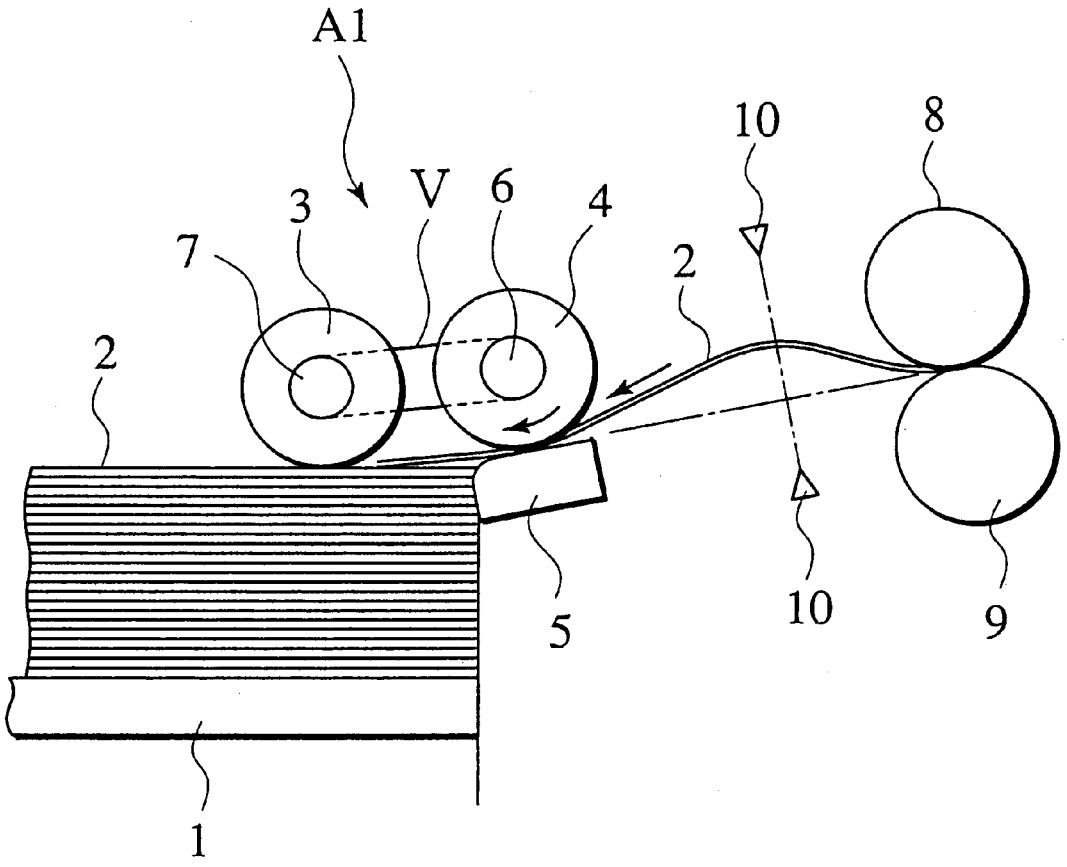
FIG. 7 is a schematic structural diagram of a conventional paper feed unit.
Figure 8:
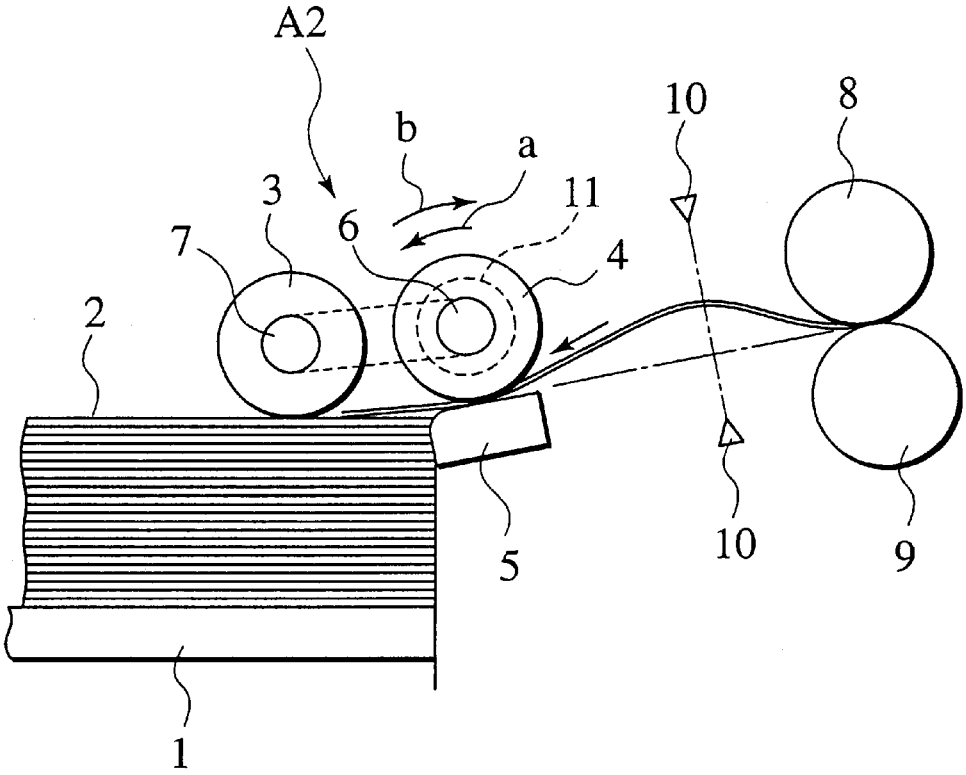
FIG. 8 is a schematic structural diagram of a paper feed unit according to the studies done by the inventors of the present invention.
Figure 9:
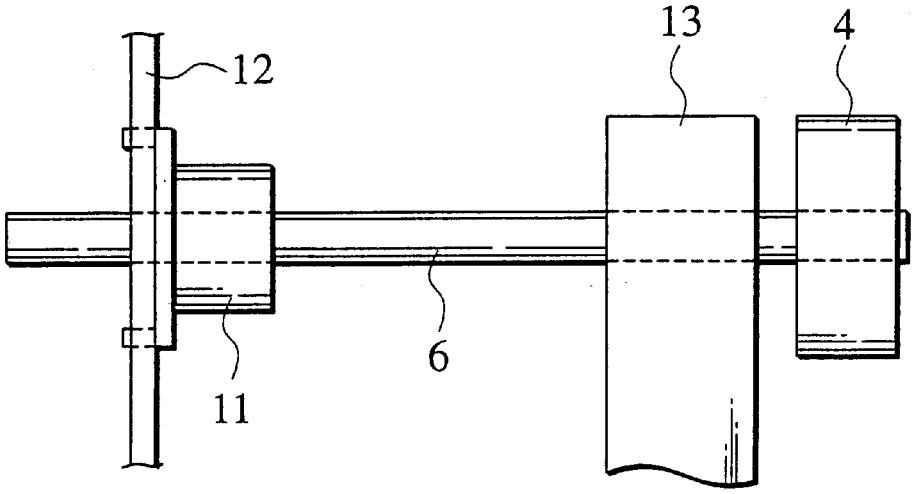
FIG. 9 is a plan view of members attached to the rotary shaft of the pickup roller of the paper feed unit shown in FIG. 8.

On the other hand, as shown in FIGS. 6A and 6B, at the rotation position of the operation lever 30 at which position the inclined faces 21*c* and 30*a* are entirely out of contact with each other, the stopper member 21 slides in an arrow E direction against the spring force of the slide spring 25 and the engagement gear teeth 21*a* of the stopper member 21 and the engagement gear teeth and 22*a* of the one-way clutch member 22 are away from each other.

Accordingly, with the above-stated constitution, the rotation stop state realized by the stopper member 21 and the one-way clutch member 22 is released.

Figure 5B:
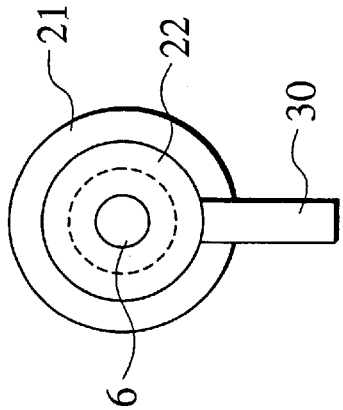
FIG. 5B is a view seen from D1 of FIG. 5A.

That is to say, the operation lever 30 can be rotated between the rotation position shown in FIGS. 5A and 5B and the rotation position shown in FIGS. 6A and 6B while the inclined face 30*a* of the operation lever 30 and the inclined face 21*c* of the stopper member 21 slide on each other. In a normal state, the operation lever 30 is set at the rotation position shown in FIGS. 5A and 5B.

A one-way clutch CC is interposed between the pickup roller 4 and the rotary shaft 6. The one-way clutch CC is constituted so as to turn the rotary shaft 6 and the pickup roller 4 into a driving state, i.e., the rotary shaft 6 and the pickup roller 4 rotate integrally with each other when the rotary shaft 6 is driven in the paper feed rotation direction a, and, on the contrary, to turn the rotary shaft 6 and the pickup roller 4 into a driving free state, i.e., the rotary shaft 6 and also the pickup roller 4 are free from the driving force when the rotary shaft 6 is to be driven in the paper feed counterrotating direction b.

Next, the paper feed operation of the paper feed unit constituted as stated above will be described below.

When the scraper roller 3 and the pickup roller 4 rotate synchronously with each other, at least the uppermost print sheet 2 press-contacted with the scraper roller 3 is transferred in X1 direction and then the transferred print sheet 2 is transferred to the position between the pickup roller 4 and the stripper tray 5.

Since the print sheet 2 which has been transferred to the position between the pickup roller 4 and the stripper tray 5 is press-contacted by the pickup roller 4, the sheet 2 is transferred further in response to the rotation of the pickup roller 4.

If it is assumed that a plurality of print sheets 2 are transferred to the position between the pickup roller 4 and the stripper tray 5, the uppermost print sheet 2 is applied with a transfer force by the rotation of the pickup roller 4 and the lowermost print sheet 2 is applied with a transfer resistance by the stripper tray 5, whereby only the uppermost print sheet 2 is transferred to the paired secondary paper feed rollers 8 and 9 side.

Then, when the paper feed sensor 10 detects the tip end of the print sheet 2 transferred, the rotation of the scraper roller 3 and that of the pickup roller 4 are stopped at the point at which the print sheet 2 has been transferred by a predetermined distance with reference to this detection point. To be specific, the print sheet 2 is contacted with the paired secondary paper feed rollers 8 and 9 while the tip end thereof is put between the paired secondary paper feed rollers 8 and 9, and transferred further from this contact position. Then, primary paper feed is completed while the print sheet 2 is being bent as shown in FIG. 1.

Following the primary paper feed, secondary paper feed is started at predetermined timing and the paired secondary paper feed rollers 8 and 9 are driven to rotate. When the paired secondary paper feed rollers 8 and 9 are thus driven to rotate, the bent print sheet 2 is put between the paired secondary paper feed rollers 8 and 9 smoothly and surely by the returning force of the print sheet 2 for returning to a linear state. The secondary paper feed is, therefore, performed accurately and surely. On the other hand, the rear end of the print sheet 2 which has been fed primarily is press-contacted with the pickup roller 4. Since the pickup roller 4 can be rotated in the paper feed rotation direction a, smooth secondary paper feed operation is surely allowed.

Meanwhile, when the primary paper feed is completed in a state in which the print sheet 2 is being bent in the course of the above-stated paper feed operation, a pressing force in the counterrotating direction acts on the pickup roller 4 by the returning force of the bent print sheet 2 for returning to a linear state as shown in arrow X2 in FIG. 1. However, the counter rotation of the pickup roller 4 is prevented by the one-way clutch member 22 and the stopper member 21 of the counter rotation stop mechanism B. Due to this, there is not substantially any probability that the rear end of the print sheet 2 which has been primarily fed presses the uppermost print sheet 2 on the paper feed tray 1.

To be specific, if a rotation force in the paper feed counterrotating direction b acts on the pickup roller 4, the force then acts on the one-way clutch member 22 through the rotary shaft 6. Although the one-way clutch member 22 intends to rotate by this force, the rotation of the pickup roller 4 is prevented. This is because the engagement gear teeth 22*a* of the one-way clutch member 22 and the engagement gear teeth 21*a* of the stopper member 21 are engaged with each other at the position, shown in FIGS. 5A and 5B, at which the inclined face 21*c* of the stopper member 21 and the inclined face 30*a* of the operation lever 30 entirely contact with each other.

Further, if the jamming of the primarily fed print sheets 2 occurs, the operation lever 30 is rotated from the position shown in FIGS. 5A and 5B to the position shown in FIGS. 6A and 6B. Then, the engagement gear teeth 22*a* of the one-way clutch member 22 and the engagement gear teeth 21*a* of the stopper member 21 are disengaged from each other. As a result, even if a rotation force in the paper feed counterrotating direction b acts on the rotary shaft 6, the one-way clutch member 22 itself freely rotates together with the rotary shaft 6. Accordingly, the print sheet 2 is not stopped by the one-way clutch member 22 and the stopper member 21.

Thus, even if sheet jamming occurs, it is possible to ensure pulling out the print sheet 2 which has caused jamming from the paper feed tray 1.

After removing the print sheet 2 which has caused jamming, the force applied to the operation lever 30 is released so that the lever 30 is located at the position shown in FIGS. 6A and 6B. Then, the operation lever 30 automatically returns to the position shown in FIGS. 5A and 5B by the reactive force of the slide spring 25.

In this embodiment, the counter rotation stop mechanism B comprises the one-way clutch member 22 and the stopper member 21. Needless to say, the mechanism B should not be limited to this constitution. Any mechanisms which allow the rotation of the rotary shaft 6 in the paper feed rotation direction a and stop the rotation thereof in the paper feed counterrotating direction b are available.

Furthermore, while the rotation stop release mechanism C comprises the operation lever 30 in this embodiment, the mechanism C should not be limited to this constitution. Any mechanisms which can release the rotation stop operation of the counter rotation stop mechanism B are available.

Further, while description has been given to a case where the paper feed unit A is applied to the paper feed section SP of the stencil printing machine S in this embodiment, the present invention should not be limited thereto. Even a printing machine and a copying machine other than the stencil printing machine are available if the machines are each provided with a paper feed section for feeding print sheets 2 stacked on a paper feed tray one by one.

As stated above, according to the constitution of this embodiment, if the primary paper feed is completed in a state in which the print sheet is being bent, a pressing force in the counterrotating direction acts on the primary paper feed roller by the returning force of the bent paper sheet for returning to a linear state. If the counter rotation of the primary paper feed roller is stopped by the counter rotation stop mechanism and the rotation stop operation of this counter rotation stop mechanism is released by the rotation stop release mechanism and a tensile force for pulling the primarily fed sheet is applied from the paper feed tray side with a hand or the like, then the primary paper feed roller rotates in the counterrotating direction and the sheet can be pulled out. It is, therefore, possible to effectively prevent the positions of the sheets on the paper feed tray from being disordered by the primarily fed sheet and to easily, surely remove the sheet which has caused jamming during the primary paper feed.

Specifically, if the primary paper feed is completed while the sheet is being bent, a pressing force in the counterrotating direction acts on the primary paper feed roller by the returning force of the bent sheet for returning to a linear state. However, the counter rotation of the primary paper feed roller is stopped by the engagement state in which the one-way clutch member and the stopper member are engaged with each other. Besides, if the operation lever turns the on-way clutch member and the stopper member into a disengagement state, the rotation of the one-way clutch member becomes free. As a result, if the primarily fed sheet is pulled out from the paper feed tray side, the primary paper feed roller rotates in the counterrotating direction, thereby making it possible to pull out the sheet.

The paper feed unit constituted as stated so far can be appropriately applied to the paper feed section of a printing machine.

The entire content of a Patent Application No. TOKUGAN 2000-145582 with a filing date of May 17, 2000 in Japan is hereby incorporated by reference.

Although the invention has been described above by reference to a certain embodiment of the invention, the invention is not limited to the embodiment described above. Modifications and variations of the embodiment described above will occur to those skilled in the art, in light of the teachings. The scope of the invention is defined with reference to the following claims.

What is claimed is:

1. A paper feed unit comprising:

a paper feed tray stacking sheets thereon;

a primary paper feed roller;

a secondary paper feed member provided downstream to the primary paper feed roller in a transferring direction of the sheets, an uppermost sheet among the sheets stacked on the paper feed tray being transferred toward the secondary paper feed member by rotation of the primary paper feed roller, the sheet being further transferred while a tip end of the sheet contacts with the secondary paper feed member, and primary paper feed being then completed while the sheet is being bent;

a counter rotation stop mechanism allowing the primary paper feed roller to rotate in a paper feed direction but preventing the primary paper feed roller from rotating in a counter direction to the paper feed direction; and a rotation stop release mechanism releasing a state in which the primary paper feed roller is prevented from rotating in the counter direction by the counter rotation stop mechanism.

2. A paper feed unit according to claim 1, wherein the counter rotation stop mechanism comprises a stopper member having a first engagement section and a one-way clutch member having a second engagement section, and prevents the primary paper feed roller from rotating in the counter direction to the paper feed direction when the first engagement section of the stopper member and the second engagement section of the one-way clutch member are engaged with each other.

3. A paper feed unit according to claim 2, wherein the counter rotation stop mechanism has a spring member urging the stopper member against the one-way clutch member.

4. A paper feed unit according to claim 3, wherein the stopper member, the one-way clutch member and the spring member are provided to surround a rotary shaft relating to the primary paper feed roller.

5. A paper feed unit according to claim 2, wherein the first engagement section of the stopper member and the second engagement section of the one-way clutch member have corresponding gear teeth, respectively.

6. A paper feed unit according to claim 1, wherein the rotation stop release mechanism is an operation lever interposed between the stopper member and the one-way clutch member.

7. A paper feed unit according to claim 6, wherein the stopper member of the counter rotation stop mechanism has a first inclined face and the operation lever has a second inclined face corresponding to the first inclined face; and the first inclined face and the second inclined face slide on each other in response to a movement of the operation lever, thereby releasing the state in which the primary paper feed roller is prevented from rotating in the counter direction.

8. A paper feed unit according to claim 6, wherein the operation lever has a portion surrounding the rotary shaft relating to the primary paper feed roller.

9. A paper feed unit according to claim 1, wherein the secondary paper feed member is provided with a pair of rollers.

10. A paper feed unit according to claim 9, wherein after the primary paper feed, secondary paper feed is performed through the pair of rollers.

11. A paper feed unit according to claim 1, wherein the paper feed unit is used as a paper feed section of a printing machine.

* * * * *